US005593458A

United States Patent [19]

Dickson et al.

[11] Patent Number: 5,593,458

[45] Date of Patent: Jan. 14, 1997

[54] PROCESS AND COMPOSITION FOR DECORATING A DYED CLOTH FABRIC

[75] Inventors: Glen A. Dickson, St. Hedwig; Donnie R. Gray, Dilley, both of Tex.

[73] Assignee: Ocean Wash, Inc., Dilley, Tex.

[21] Appl. No.: 405,001

[22] Filed: Mar. 16, 1995

[51] Int. Cl.[6] ..... D06L 3/02; D06L 3/14; D06L 3/16

[52] U.S. Cl. ..... 8/102; 8/107; 8/108.1; 8/110; 8/111; 8/114; 8/115; 8/457; 8/458

[58] Field of Search ..... 8/102, 107, 108.1, 8/110, 111, 101, 114, 114.6, 115, 137, 457, 458; 252/186.1, 186.43, 187.23, 187.24, 187.25, 187.26, 187.27, 187.28, 187.34, 95

[56] References Cited

U.S. PATENT DOCUMENTS

| | | | |
|---|---|---|---|
| 1,659,598 | 2/1928 | Funk . | |
| 3,575,865 | 4/1971 | Burke et al. | 252/99 |
| 3,639,248 | 2/1972 | Moyer et al. | 252/186.31 |
| 3,676,341 | 7/1972 | Gerecht et al. | 252/8.8 |
| 3,715,314 | 2/1973 | Morgenstern | 252/95 |
| 3,731,986 | 5/1973 | Fergason . | |
| 3,977,980 | 8/1976 | Fry et al. | 252/8.8 |
| 4,116,851 | 9/1978 | Rupe et al. | 252/103 |
| 4,181,756 | 1/1980 | Fergason . | |
| 4,193,888 | 3/1980 | McHugh | 252/99 |
| 4,347,153 | 8/1982 | Hooper et al. | 252/174.25 |
| 4,352,678 | 10/1982 | Jones et al. | 252/528 |
| 4,386,992 | 6/1983 | Takegawa et al. . | |
| 4,387,107 | 6/1983 | Klein et al. . | |
| 4,387,153 | 6/1983 | Bonneron . | |
| 4,450,188 | 5/1984 | Kawasumi . | |
| 4,541,340 | 9/1985 | Peart et al. . | |
| 4,622,056 | 11/1986 | Matsuo et al. . | |
| 4,740,213 | 4/1988 | Ricci | 8/108.1 |
| 4,789,621 | 12/1988 | Knoth . | |
| 4,900,323 | 2/1990 | Dickson et al. | 8/111 |
| 4,919,842 | 4/1990 | Dickson et al. | 252/186.43 |
| 4,927,180 | 5/1990 | Trundle et al. . | |
| 4,954,138 | 9/1990 | Butcher et al. . | |
| 4,961,749 | 10/1990 | Clements | 8/109 |
| 4,961,751 | 10/1990 | Eissele et al. | 8/111 |
| 4,999,025 | 3/1991 | Patton | 8/111 |
| 5,006,124 | 4/1991 | Tieckelmann et al. | 8/111 |
| 5,053,306 | 10/1991 | El-Sayed et al. . | |
| 5,114,426 | 5/1992 | Milora et al. | 8/102 |
| 5,131,915 | 7/1992 | Mendoza | 8/457 |
| 5,172,937 | 12/1992 | Sachetti . | |
| 5,190,562 | 3/1993 | Dickson et al. | 8/111 |
| 5,213,581 | 5/1993 | Olson et al. | 8/401 |
| 5,215,543 | 6/1993 | Milora et al. | 8/102 |
| 5,221,590 | 6/1993 | Bugner . | |
| 5,310,409 | 5/1994 | Friday | 8/102 |
| 5,352,243 | 10/1994 | Ashizawa et al. | 8/401 |

FOREIGN PATENT DOCUMENTS

| | | |
|---|---|---|
| 0177165 | 8/1985 | European Pat. Off. . |
| 0275432 | 12/1987 | European Pat. Off. . |
| 0288722 | 3/1988 | European Pat. Off. . |
| 0292178 | 5/1988 | European Pat. Off. . |

OTHER PUBLICATIONS

"Men's Jeans Take a 'Lite' for '87", Daily News Record (NY), vol. 16, No. 159; Friday, Aug. 22, 1986 (2pp).

"Spinners, Knitters See Indigo Yarn Use Growing Despite Production Woes", Daily News Record (NY); Wednesday, Sep. 11, 1986 (2pp).

"Denim's Trails and Tribulations", Manufacturing Clothier--Britian's Only Independent Clothing Trade Monthly, vol. 68, No. 9; Sep. 1987 (cover, index, 3-page article).

"The Photographic Stencil Method"; Chapter Eight (pp. 105–121) (Date Unknown).

Vanderbilt Report (R. T. Vanderbilt Company, Inc., Norwalk, CT); No. 902 (Date Unknown).

"Rhodopol®" Industrial Grade Xanthan Gum, (R. T. Vanderbilt Company, Inc., Norwalk, CT) (Date Unknown).

"Minerals and Chemicals for Industry from the Specialties Department of R. T. Vanderbilt Company, Inc.", (R. T. Vanderbilt Company, Inc.) (No. 786) (Date Unknown).

"Veegum® The Super Natural Ingredient", (R. T. Vanderbilt Company, Inc.) (Booklet No. 97), Sep. 1987.

*Primary Examiner*—Prince Willis, Jr.
*Assistant Examiner*—Alan D. Diamond
*Attorney, Agent, or Firm*—Gunn, Lee, Miller, P.C.

[57] ABSTRACT

A processing composition for decorating a dyed cloth fabric. The composition is a dye reactive oxidizer carrying gel and the method of use is to silkscreen onto the fabric to be decorated with the oxidizing gel. The gel is allowed to react with the dye of the fabric in a pattern dictated by the silkscreening pattern. The oxidizing agent is then removed from the fabric.

10 Claims, No Drawings

PROCESS AND COMPOSITION FOR DECORATING A DYED CLOTH FABRIC

FIELD OF THE INVENTION

A process and composition for decorating a dyed cloth fabric, more specifically, a process of using a silkscreen or other stencil and an oxidizing gel to remove from the fabric workpiece dye reactive with the oxidizing gel, the removal duplicating the silkscreen or stencil pattern.

BACKGROUND OF THE INVENTION

Serigraphy is the making of silkscreen prints. A piece of silk, nylon, monofilament polyester, multifilament polyester, organdy, or other suitable material is stretched over a frame. The material has open mesh and mesh blocked in selected areas and thus acts as a screen or stencil, the unblocked areas for allowing ink to pass through the fabric on the underlying surface to be printed. Ink or other pigment carrying medium is typically poured over the screen and then scrapped, with a squeegee or the like over the fabric. This forces the ink or pigment through the unblocked mesh to transfer the ink or pigment to the fabric in a pattern reflecting the silkscreen pattern.

Applicants provide, however, a silkscreen, including fabric and emulsion, that will not react with or be damaged by the presence of an oxidizer, such as bleach, as well as a gel bleach composition of suitable viscosity such that it will pass through the open pores of the silkscreen and not run or migrate horizontally in the fabric yet to be blocked by the nonporous regions of the silkscreen. Thus, applicants provide a method and composition suitable to decorate a dyed fabric, such as indigo dyed cotton denim, by dye removal.

OBJECTS OF THE INVENTION

It is an object of the present invention to provide a composition suitable for use with a silkscreening method, which composition is comprised of a two-phase colloidal suspension of a solid and a liquid, typically a gel containing an oxidizer. The oxidizer is reactive with the dye of the fabric workpiece such that, when the gel composition is applied through the silkscreen to the workpiece, dye removal is effective to transfer the pattern from the silkscreen to the fabric workpiece.

It is a further object of the present invention to provide a method for transferring an aesthetically pleasing pattern from a silkscreen, stencil, or the like onto a dyed fabric, utilizing the silkscreen or stencil in conjunction with an oxidizing composition of suitable viscosity to penetrate the mesh of the silkscreen or a stencil through to the fabric workpiece beneath.

SUMMARY OF THE INVENTION

Applicants' unique composition is typically comprised of a liquid oxidizing agent, such as sodium hypochlorite or potassium permanganate, and a thickening or gelling composition. Typically, water is mixed with a thickening or gel agent, to which the oxidizer is added, to an effective viscosity such that it can effectively oxidize a fabric workpiece when urged through the openings of the mesh of a silkscreen or stencil.

Applicants' novel method is comprised of silkscreening or stenciling onto a fabric workpiece comprised of a dye reactive with an oxidizer, a gel composition of suitable viscosity and capable of reacting with the dye to create an aesthetic pattern more reflective of the silkscreen onto the fabric workpiece.

DETAILED DESCRIPTION OF THE PREFERRED EMBODIMENT

Silkscreening is a well-known process by which a screen or mesh is covered or blocked in negative or positive image areas while leaving image areas of the screen open so that printing inks or pigments may pass through the screen in the open mesh image areas to produce an image on a surface immediately behind the screen. To make a suitable printing screen, mesh of silk, monofilament polyester, organdy, multi-filament polyester, nylon, or other suitable materials is stretched taut across a frame and affixed to the edges to prevent the mesh from sagging during the printing process.

There have been a number of methods of producing non-photographic screens. For example, paper stencils are cut to create a negative image, the paper then adhered to the screen, and printing ink is passed through uncovered image areas to create the positive image on the surface behind the screen.

Blockout is a method used to create a silkscreen by applying a masking material to the desired negative image areas of the screen. The blockout material may consist of a glue, shellac, or other material not affected by the screen printing ink, but able to clog the screen.

Another method of making a non-photographic stencil is with hand cut film of gelatin-like layers applied evenly over a paper or plastic film. The layers are hand cut with a sharp blade. The image desired and the gelatin are adhered to the mesh with solvent or with water. Once it's adhered and dried, the backing sheet is peeled off the screen leaving the cut image to create the stencil.

Another process for preparing an imaging screen involves the use of photosensitive coatings, referred to as emulsions, to coat the screen. The emulsions contain polymers which cross-link when exposed to light in the visible or ultraviolet frequencies. The photosensitive emulsions are coated on meshes or screens which are then stretched tightly across the frame under darkened or safe life conditions. Emulsions are allowed to dry. Any obliterating material, such as an opaque film positive, is then placed over the screen for shielding imaging areas of the screen and the screen is then exposed to radiant light, causing the polymers to react in the exposed negative areas of the screen. The exposed areas are adhered to the mesh. The non-exposed emulsion is subsequently selectively removed from the screen by, for example, washing the screen with warm water. After the screen is dried, the screen can be used for printing, with ink passing through image areas from where the non-exposed emulsion has been removed.

These and other methods for preparing silkscreen, non-reactive with the chemicals and oxidizers of applicants' preferred composition, are anticipated. The silkscreen so produced is stretched tightly across a frame in ways known in the trade. The fabric workpiece, typically dyed cloth comprising a garment, such as a shirt or a jacket, is placed beneath the silkscreen. The screen is urged directly against the flat laying fabric and the application of applicants' unique gel oxidizing composition is then in order.

In order to bleach or oxidize the fabric following the preparation of the silkscreen stencil by any of the methods set forth above or any method known in the art, the work piece, typically but not necessarily indigo dyed cotton denim, is placed beneath the silkscreen with the ladder pressed firmly against the surface of the work piece. The gel is then placed along one end edge of the silkscreen and squeegeed across. The gel, if of the proper viscosity, will be forced through the openings in the mesh and blocked from those areas in which the mesh is impervious.

The preferred composition of the present invention is a two-phase (solid dispersed throughout a liquid medium) colloid suspension, typically a gel composition containing an oxidizing agent, typically in the liquid state, and a dispersed gelling or thickening agent. The preferred oxidizing agents (non-reactive with the silkscreen) are hypochlorites, chlorites, and permanganate oxidizers. Early indications show that the permanganate oxidizers do not adversely affect the screen as much as the chlorine-based oxidizers. Nor are the gelling agents intended to be limited to the specific embodiments enclosed. Indeed, both organic and inorganic gelling agents have been disclosed and used in the compositions and methods set forth herein. The specifications and claims are intended to apply to combinations of gelling compositions and oxidizers regardless of their origin and nature. The preferred gelling agents are nonorganic smectite clays, aluminum silicates, attapulgite clay, silicon dioxide, fumed silica, colloidal silicas, modified montmorillonite clay, and amorphous silica powder.

To provide the proper consistency to the composition, applicants utilize a gelling or thickening agent which is typically derived from either organic or inorganic sources. Particularly useful as gelling agents in applicants' invention are natural smectite clays; such as magnesium aluminum silicates; and bentonite clays. A gel may be made in a variety of ways, but the gel used by applicants will typically substantially cling to a vertical surface and has a preferred viscosity range.

A gel is a two-phase colloid in which the disperse phase (solid) has combined with the continuous phase (liquid) to produce a viscous jelly-like product. The gel dispersion, typically of a solid and liquid may range from nearly liquid to the solid state, but is typically a semi-solid and of a jelly-like consistency, such as gelatin, mucilage, uncooked egg-white and the like.

Typically, gel solutions' viscosity depends upon their previous treatment. If the solution has been subject to large shear forces (such as being agitated or stirred rapidly), its fluidity is changed. But after some time, it returns to its former, more viscous condition. Gels also typically exhibit elasto-plastic deformation.

A great portion of the gel volume is typically occupied by a liquid (dispersion medium). Typically, the dispersed medium is a small percent of the liquid by both weight and volume of the gelling agent to the liquid. Often, where the liquid phase is water, it retains the ability to diffuse small molecules, such as a bleaching or oxidizing agent, throughout the liquid component without reacting to the gelling agent.

Here, applicants use the oxidizing agent and gelling agent to produce a gel composition of appropriate viscosity that, when transferred to a dyed garment by silkscreen, produces a pleasing effect by bleaching those areas of fabric beneath the open mesh or cutout portion.

That is, applicants' unique colloidal composition will substantially penetrate the unblocked mesh of the fabric during the transfer step of the silkscreening process. However, the composition is not so fluid that it will run horizontally across the fabric workpiece.

Among applicants' preferred gelling agents are the inorganic smectite clays such as VEEGUM and VAN GEL, products of the R. P. Vanderbilt Company, Inc., 30 Winfield St., Norwalk, Conn. 06855 which are known to persons skilled in the art. Both VEEGUM and VAN GEL are complex colloidal magnesium aluminum silicates. VEEGUM is used in some formulations as a suspending agent, emulsion stabilizer and viscosity modifier. It is supplied as an insoluble flake which forms colloidal dispersions in water. VAN GEL is an industrial thickener and suspending agent developed for industrial and agricultural uses. It is supplied as a small flake which disperses in water easily with high shear mixing. A description of these and other properties of VEEGUM and VAN GEL may be found in a folder entitled, "Minerals and Chemicals For Industry From The Specialties Department of R. T. Vanderbilt Company, Inc." #786 available from Vanderbilt. Gelulite, lapitonite (synthetic clay), bentolites, mineral colloid, asterben (sodium bentonite)—all from Southern Clay, Inc.

VEEGUM and VAN GEL have heretofore been used in the development of new household and institutional cleaning products for applications including basin, tub and tile, oven and grill, rug, toilet bowl cleaners, and paint and varnish removers, in part because they have excellent resistance to attack and degradation by strong acids, bases, and oxidizing agents. VEEGUM and VAN GEL are not soluble in water but can be dispersed in water to form a colloidal structure similar to a "house of cards". The colloidal "house of cards" structure accounts for the ability of these compositions to thicken and develop yield value in the products which they are contained. Yield value provides a vertical surface cling to the formulations while thickening provides different pouring and flow properties.

While this method and this composition, indeed the specifications of this application, frequently refer to the treatment of garments and in particular, the treatment of cotton-based fabric such as denim, the method and compositions described and claimed herein are in no ways so limited. The methods and compositions may be used with fabric before that fabric is cut up and sewn into garments. The methods and compositions claimed also apply to fabric other than cotton-based fabric, including but not limited wholly or partially synthetic fabrics and including fabrics that are combinations of synthetic and organic fibers.

The blending order of the ingredients is, typically, mixing water and the thickening or the gelling agent, here preferably VEEGUM®, VAN GEL®, or Bentonite WH. Some gelling or thickening will be seen to occur after several minutes of stirring. Following the blending of the water and the gelling or thickening agent, solid potassium manganate (oxidizer) is added as well as any stabilizers or accelerators and continued mixing takes place until the desired viscosity is reached.

Stabilizers are used to slow down the deterioration of the activity of the bleach when chlorine-based oxidizers are used. Stabilizers include compositions such as soda ash added in about 4% by weight of the composition, which has been shown to help maintain chlorine activity while the composition is in storage and gives the composition more body.

An additional component may be added to the gel composition to adjust the pH. For example, acetic acid has been found to be effective in reducing the pH of the gel composition when such reduction is called for. Altering the pH of the workpiece before it gets silkscreened with the composition will affect the action of the oxidizer.

Having discussed in general a typical blending order of the ingredients of applicants unique composition, attention will now be turned to preparing a large working batch. This particular batch was mixed in a steel tank, 160 gallon capacity with two 3-blade props, 16 inches in diameter, and driven by a ⅓ horsepower electric motor. One hundred thirty (130) gallons of water at 150° F. is provided, into which is mixed approximately 125 pounds of Bentonite WH as a gelling agent. This is mixed for approximately 1 hour in a lightning mixer. There will be some thickening of the water achieved, typically to approximately 1,000 cps or so.

About 17 pounds of dry sodium bicarbonate powder mixture is mixed in, the mixing continuing for about 15 minutes during which the composition thickens, typically to 1,500 to 2,000 cps.

Following the addition of sodium bicarbonate, potassium permanganate, the oxidizer (approximately 23 pounds) is added to the tank and mixed for about 25 minutes.

By varying the amount of gelling or thickening agent, the viscosity resulting from the mix will be preferably between 6,500 and 50,000 cps as measured in a 600 ml beaker at 72° F. using a Brookfield Model RD Viscometer with a No. 4 Spindle at 20 rpm. The general range of viscosities for applicants two-phase suspension is between 3,000 and 35,000 cps.

The second, albeit smaller, working recipe utilizes a chlorine-based bleach and includes mixing 28.6 pounds of water at 150° F. with about 6.0 pounds of Bentonite WH and 1.4 pounds of powder soda ash. The oxidizer is dry calcium hypochlorite, 65% available chlorine and the mixture is then added together in the same order as set forth previously (first adding the water to the Bentonite WH to thicken it, followed by the addition of soda ash, then sodium hypochlorite). The mixture results in a composition having about 12,000 cps viscosity and 5.5% available chlorine. When using the chlorine-based oxidizer, the preferred activity of the composition is 0.10 percent to 6.5 percent available chlorine by weight. It is preferable that the pH of applicants' composition be between 4 and 13.

Typical mesh size for silkscreen are: 80, 120, 150, 155, and 280. Typically, a coarse mesh is between 60 and 90, medium mesh between 125 and 144, and a fine mesh above 280. The preferred mesh for applicants present invention is a coarse or medium mesh used with the gel composition with a viscosity range of 3,000 to 50,000, preferably between 10,000 to 40,000 cps.

An example of an appropriate silkscreen nonreactive with applicants' potassium permanganate formulation is a silkscreen made of polyester material, having an oil emulsion applied by ways known in the art. The silkscreen is stretched across a frame. A gel composition comprising potassium permanganate as the oxidizing agent and Bentonite WH as the gelling agent and mixture to a viscosity of approximately 35,000 is applied to the 110 mesh screen and squeegeed across the screen onto an underlying indigo dyed denim garment. The squeegee used is 70 Durometer hardness and an appropriate amount of pressure is utilized to force the gel composition through the unobstructed mesh.

Following the application of the gel to the garment, the garment is post-washed by the following process:

Step 1: gel is to be antichlored or neutralized;

Step 2: garment is rinsed or scoured;

Step 3: garment is rinsed or softener is added;

Step 4: garment is extracted and dried.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A process of altering the appearance of a dyed cloth fabric, the process comprising the steps of:

providing a dye reactive oxidizer medium consisting of:

a dye reactive oxidizing agent;

a gelling or thickening agent selected from magnesium aluminum silicates, nonorganic smectite clays, bentonite clays, attapulgite clay, silicon dioxide, fumed silica, colloidal silicas, modified montmorillonite clay, or amorphous silica powder;

an additional component selected from a stabilizer to stabilize the activity of said dye reactive oxidizing agent or an accelerator to accelerate the activity of said dye reactive oxidizing agent; and water;

laying said fabric on a flat surface;

overlaying the fabric with a stenciling member having a dye reactive oxidizer carrying medium transparent portion and a dye reactive oxidizer carrying medium opaque portion;

at least partially covering the stenciling member with the dye reactive oxidizer carrying medium;

forcing the dye reactive oxidizer carrying medium through the dye reactive oxidizer carrying medium transparent portion of the stenciling member until the dye reactive oxidizer medium contacts the fabric;

allowing the dye reactive oxidizer carrying medium to react with the dye of the fabric; and removing the stenciling member of the overlaying step from the fabric.

2. The process as set forth in claim 1, wherein the dye reactive oxidizing agent is effective in removing dye from the fabric.

3. The process as set forth in claim 1 wherein the dye reactive oxidizing agent of the providing step is selected from the group consisting of potassium permanganate, sodium hypochlorite, calcium hypochlorite, sodium chlorite, lithium hypochlorite, sodium permanganate, and dichloroisocyanuric acid.

4. The process as set forth in claim 1, wherein the stenciling member of the overlaying step is a silkscreen.

5. The process as set forth in claim 1, wherein the stenciling member is a mesh.

6. A method for selectively bleaching sections of a dyed cloth fabric comprising:

silkscreening onto selected areas of the cloth fabric a silkscreenable gel consisting of:

a dye reactive oxidizing agent;

a gelling or thickening agent selected from magnesium aluminum silicates, nonorganic smectite clays, bentonite clays, attapulgite clay, silicon dioxide, fumed silica, colloidal silicas, modified montmorillonite clay, or amorphous silica powder;

an additional component selected from a stabilizer to stabilize the activity of said dye reactive oxidizing agent or an accelerator to accelerate the activity of said dye reactive oxidizing agent;

and water, wherein said gel bleaches a dye of the cloth fabric; and removing the gel after the dye has been bleached from the fabric.

7. The method of claim 6 further comprising the step of post-washing the fabric, the post-washing step following the removing step.

8. The method of claim 6, wherein the dye reactive oxidizing agent is potassium permanganate.

9. The method of claim 6, wherein the viscosity range of the gel is in the range of 3,000 to 50,000 c.p.s at 72° F. measured with a Brookfield viscometer at 20 rpm.

10. The method of claim 6, wherein the mesh size of the silkscreen is 60 to 280.

* * * * *